US006095929A

United States Patent [19]

Clark

[11] Patent Number: 6,095,929

[45] Date of Patent: Aug. 1, 2000

[54] UNIVERSAL PUTTER LIE ANGLE ADAPTER FOR GOLF CLUB

[76] Inventor: Edward L. Clark, 601 Brooks Ave., Raleigh, N.C. 27607

[21] Appl. No.: 08/390,403

[22] Filed: Feb. 16, 1995

[51] Int. Cl.[7] ..... A63B 53/02

[52] U.S. Cl. ..... 473/248; 473/313

[58] Field of Search ..... 273/193 B, 80.1, 273/80.5, 80 C, 167 G, 80.3, 80.2, 80.8, 81.2, 81.3; 473/232, 246, 248, 251, 305, 307–309, 313–315

[56] References Cited

U.S. PATENT DOCUMENTS

| | | | |
|---|---|---|---|
| 1,486,823 | 3/1924 | Allen . | |
| 1,535,707 | 4/1925 | Barnes . | |
| 1,550,665 | 8/1925 | Barnes . | |
| 1,765,982 | 6/1930 | Keating . | |
| 2,155,830 | 4/1939 | Howard . | |
| 2,644,689 | 7/1953 | Putnam . | |
| 3,096,982 | 7/1963 | Bassin . | |
| 3,102,726 | 9/1963 | Barrett . | |
| 3,191,936 | 6/1965 | Guier | 473/313 |
| 3,397,888 | 8/1968 | Springer et al. | 473/248 |
| 3,423,089 | 1/1969 | Andis . | |
| 3,909,005 | 9/1975 | Piszel . | |
| 4,736,951 | 4/1988 | Grant . | |
| 4,815,740 | 3/1989 | Williams et al. . | |
| 4,856,782 | 8/1989 | Cannan | 473/232 |
| 4,881,737 | 11/1989 | Mullins . | |
| 4,984,794 | 1/1991 | Pernelle et al. . | |
| 5,244,205 | 9/1993 | Melanson et al. . | |
| 5,277,427 | 1/1994 | Bryan et al. | 473/232 |
| 5,308,063 | 5/1994 | Vendur . | |
| 5,320,346 | 6/1994 | Phillips . | |
| 5,390,919 | 2/1995 | Stubbs et al. | 473/246 |

*Primary Examiner*—Steven Wong
*Attorney, Agent, or Firm*—Jenkins & Wilson, P.A.

[57] ABSTRACT

A novel device is provided which enables a golfer to adjust the inclined angle of the putter shaft to the putter head so as to satisfy that individual's preference. The device can be used with virtually any combination of putter heads and shafts.

A two component embodiment consists of one component connected to the putter head and the second component fastened to the shaft. The faces of the components are pivotally secured together for selective adjustment relative to each other.

A one-piece fixed angle embodiment has an upper end adapted to fit the club shaft and the lower end fitted to the putter head. A preselected angle between the ends of the component determines the golfer's preferred angle of inclination or lie angle.

5 Claims, 3 Drawing Sheets

UNIVERSAL PUTTER LIE ANGLE ADAPTER FOR GOLF CLUB

TECHNICAL FIELD

The present invention relates to golf clubs, and more particularly to putters with adjustable putter heads.

RELATED ART

Typical par golf allows half of the strokes to be putts on the green. The putter club is so important to the game that millions of golfers search for the putter which most closely "fits" them as individuals. However, different body builds and putting stances cause many golfers to compromise on their best "fit" because club manufacturers design clubs for the average person and not the individual.

The one major variable in putter club "fit" is the desired inclination angle of the shaft to the club head (lie angle) which would best suit a golfer's stance and body build. Therefore, it is the purpose of applicant's invention to provide a simple adapter device that when installed between the end of the shaft and the putter head will enable a golfer to adjust his or her putter to a desired lie angle. In order to meet U.S.G.A. rules, once this adjustment has been made, it may not be changed during play, but may be altered thereafter if the player so desires.

Various different forms of specialized putters have been provided which permit the adjustment of the lie angle between the shaft and the putter head. A variety of unique and specialized putter heads are disclosed as in U.S. Pat. Nos. 4,498,794; 3,423,089; 5,244,205; 4,881,737; 3,909,005; 4,736,951; 2,155,830; 1,550,665; 1,765,982; 3,102,726; 4,815,740; 1,486,823; 3,096,982; and 5,308,063.

However, these previously known forms of putters require a golfer to seek out a specialized putter which may not have other desired characteristics such as a particular putter head size, shape, weight, appearance, or feel. Also, golfers' preferences in shafts range from wood to steel to graphite as well as fiberglass and various alloys. None of the previously known putters enable a golfer to combine any of the dozens of different putter heads to the wide choice of shafts while still customizing a lie angle for that individual golfer.

DISCLOSURE OF THE INVENTION

The present invention will enable a golfer to adjust his or her putter to the most suitable lie angle for that individual's body build and stance. The invention would not require modification of most commercially available putter heads or shafts. The invention can be used interchangeably for either right or left hand putters. Also, club manufacturers can incorporate the inventive adapter device into their product line to offer custom-fit putters to their customers.

Some of the objects of the invention having been stated hereinabove, other objects will become evident as the description proceeds, when taken in connection with the accompanying drawings as best described hereinbelow.

BEST MODE FOR CARRYING OUT THE INVENTION

The present invention provides an adapter device to be inserted between the end of the shaft and the putter head of a golf club putter that permits a golfer to set any desired angle between the shaft and the club head (lie angle).

Referring now to FIGS. 1–8, there are two elongated components A and B utilized by adapter 10. The end of component A is fastened to the putter head in the same manner as a shaft is commonly inserted into or onto conventional golf club heads. Second component B of adapter 10 is fastened into or onto the shaft in a similar manner while considering the diameter of the lower end of the shaft and whether the shaft is tubular or solid rod.

Normally, putter heads are connected to the shaft in either of two ways:

1. The majority of putter heads have a hole or socket which is sized to receive a 0.370" diameter shaft, which is cemented in place; and
2. Other putter heads are connected to the shaft by an integral hosel or short metal stub (9/32" or 5/16" diameter) which is inserted and cemented inside a 0.370" outside diameter tubular unitized metal shaft.

Figure 1:
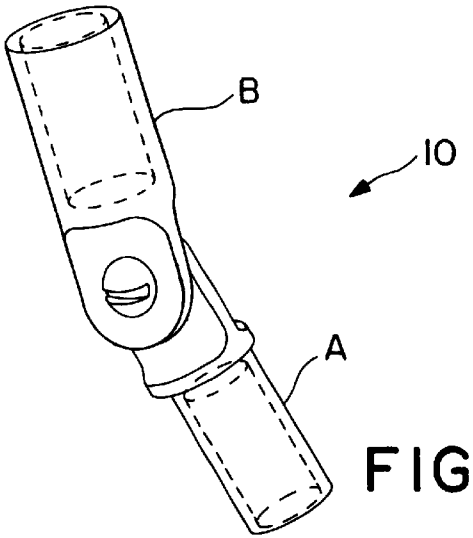
FIG. 1 is a side elevation view of the putter lie adapter of the invention.

The preferred embodiment of adapter 10 shown in FIG. 1 connects to either category of putter heads by means of a tubular sleeve component A with an outside diameter of 0.370" and an inside diameter of 0.3125" (5/16"). The outside diameter can be cemented into socket-type putter heads and the inside diameter can accept the over-hosel putter heads.

The shafts used for golf club putters may be tubular (hollow steel or alloy) or solid rods (graphite or a composite). The outside diameter of these shafts typically measures 0.370". In the preferred embodiment of adapter 10 shown in FIG. 1 component B connects to any shaft as a tubular sleeve with an inside diameter of 0.390" which slides about one inch onto the end of either a metal or a graphite shaft and is then cemented in place thereon.

It is apparent that an over-hosel type of putter head cannot be used with a solid rod (graphite) shaft in conventional golf putter clubs whereas adapter 10 of the invention makes this adaptation possible.

Figure 2:
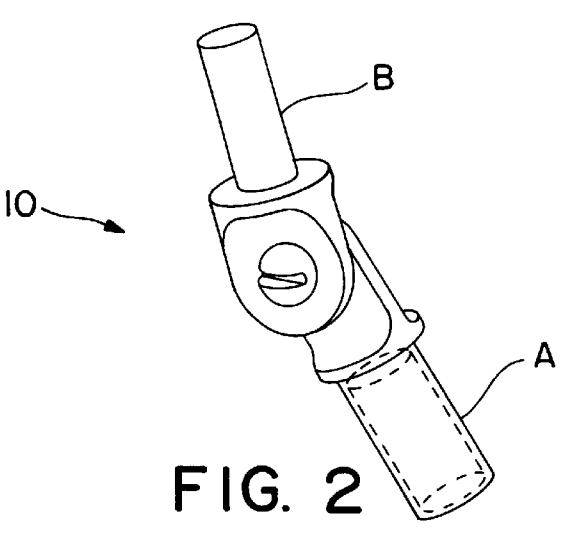
FIG. 2 is a side elevation view of a second embodiment of the invention.

An alternative embodiment for adapter 10 which connects to a 0.370" diameter tubular shaft is shown in FIG. 2 and comprises:

1. Component B comprising a one inch long rod with a diameter of 0.3125" which is cemented inside the 0.370 unitized tubular steel shaft; and
2. The other end of component B is pivotally secured to component A which is similar in construction to component A of adapter 10 in FIG. 1.

The free ends of two components A and B of adapter 10 may be pivotally joined together in any of several ways and will be able to be rotated against each other so that the angle of the shaft and the putter head is infinitely adjustable as illustrated in FIGS. 1–4. For example, components A and B may be riveted together or screwed together or joined by a spline so as to require a significant force to effect relative rotational movement therebetween. The function of the adapter 10 "joint" can be compared to the function of the ankle in changing the angle between the foot and the lower leg. When the golfer determines the angle of inclination that best suits his or her stance, the "joint" will be locked in that position with adapter 10 and thus form a customized putter for that individual. The preferred lie angle is in the range from 77° to 66° from the plane of the putter head to the shaft.

Figure 3:
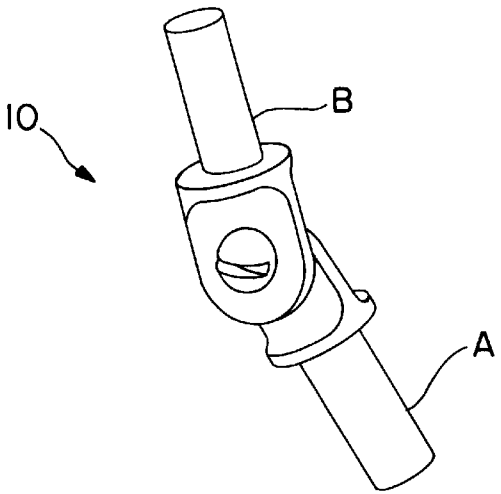
FIG. 3 is a side elevation view of a third embodiment of the invention.
Figure 4:
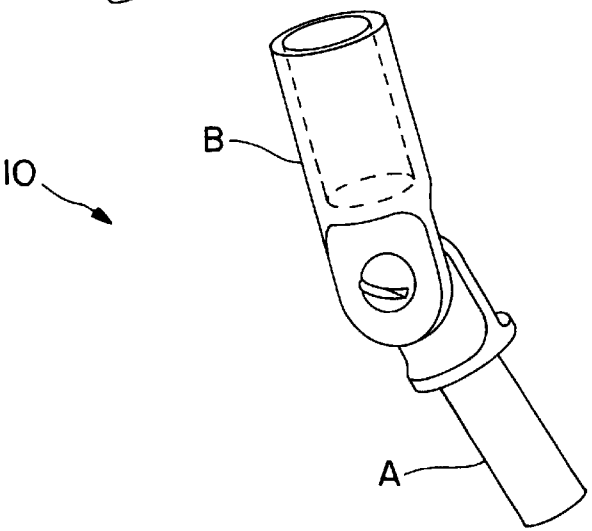
FIG. 4 is a side elevation view of a fourth embodiment of the invention.
Figure 7:
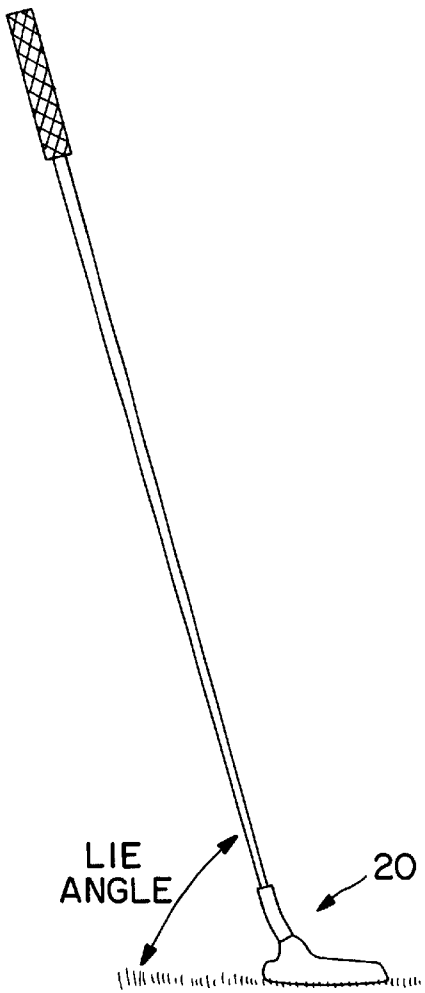
FIG. 7 is a side elevation view of a golf club putter utilizing the device shown in FIG. 5.
Figure 6:
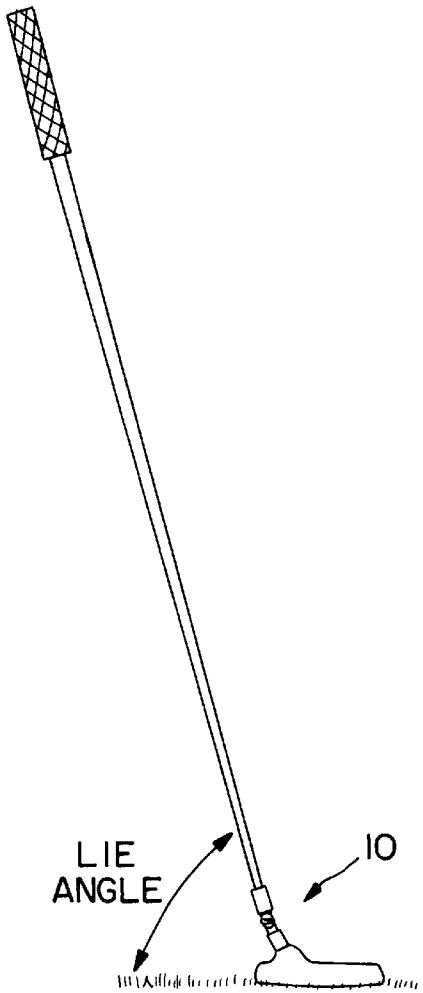
FIG. 6 is a side elevation view of a golf club putter utilizing the device shown in FIG. 1.
Figure 5:
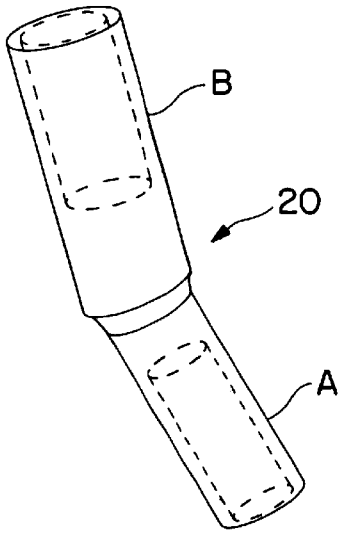
FIG. 5 is a side elevation view of a fifth embodiment of the invention.
Figure 8:
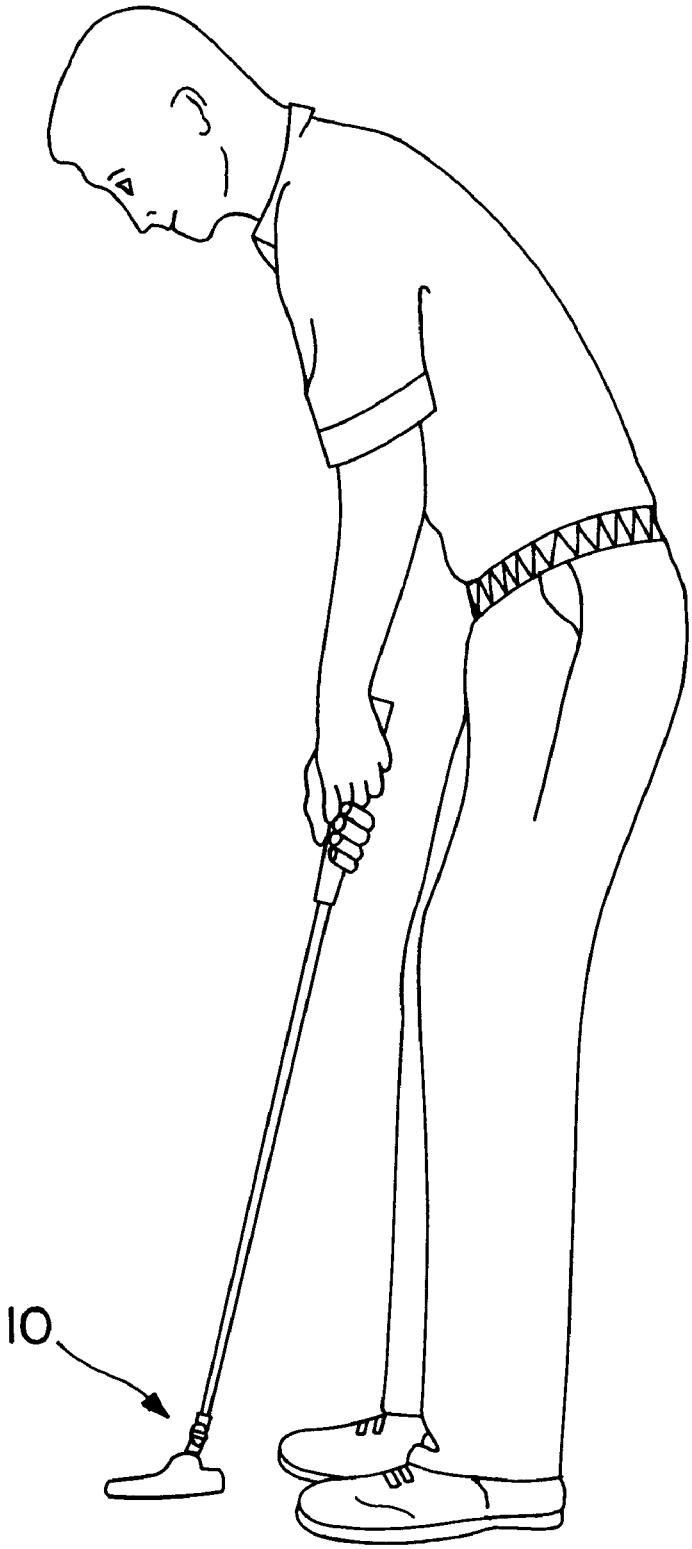
FIG. 8 is a perspective view of a golfer using the golf club putter of FIG. 6.

FIGS. 3 and 4 depict additional embodiments of adapter 10. FIG. 3 shows adapter 10 wherein components A and B each define a rod on the free end thereof, and FIG. 4 shows adapter 10 wherein components A and B define, respectively, a rod and a tubular sleeve on the free end thereof.

ALTERNATIVE EMBODIMENT PUTTER LIE ANGLE ADAPTER

A one-piece fixed angle adapter 20 (see FIGS. 5 and 7) is attached between the shaft and the putter head which effectively changes the lie angle of the club to best suit an individual's body build and stance. Preferably component A has an outside diameter of 0.370 inches and component B has an inside diameter of 0.375 inches to accommodate a 0.370 inch diameter shaft.

In commercially available putters, the lie angles commonly range from 75° to 69° from the plane of the putter head to the shaft. With the present invention, each of a plurality of fixed angle adapters 20 would offer typically a 1°–2° lie angle change within a preferred lie angle range of 77° to 66°. The golfer selects and installs that fixed angle adapter 20 best suited for his or her preferred lie angle.

The fixed angle adapters 20 (each with a different angle) may be connected to the shaft and the putter head by the same combinations of tubular or solid rod fittings as shown in FIGS. 1–4 of adapter 10 embodiment of the invention.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination (1) a golfing aid which comprises first and second elongated engagement elements each having a proximal end and a distal end and each having a longitudinal axis, (2) an elongated club shaft having a longitudinal axis, and (3) a putter club head having a longitudinal axis, and wherein the putter club head is adapted for one of a socket-type or an over-hosel type engagement with the distal end of the second elongated engagement element, the putter club head being selected from the group consisting of a socket-type puffer club head and an over-hosel type putter club head, and said elongated engagement elements are secured together at said proximal ends so as to each have a free distal end and wherein the longitudinal axis of said first and second engagement elements define a predetermined angle therebetween, wherein the distal end of said first elongated engagement element is adapted to engage the elongated club shaft so that the longitudinal axis of said first engagement element and the longitudinal axis of said club shaft are substantially coaxially aligned, and the distal end of said second elongated engagement element is adapted to engage fixedly the putter club head both by insertion into the socket-type putter head and by slidably accepting the over-hosel type putter head so that the longitudinal axis of said second engagement element and the longitudinal axis of said putter club head are substantially coaxially aligned and said putter club has a desired lie angle between 66° and 77°; whereby said golfing aid permits combination of a selected club shaft and a selected putter club head to form a personalized putter club.

2. The combination golfing aid, club shaft, and putter club head according to claim 1 wherein the club head has an elongated securement stub extending outwardly from the club head, and said second elongated element fixedly engages the elongated securement stub, so that the longitudinal axis of said second engagement element and the longitudinal axis of said putter club head securement stub are substantially coaxially aligned.

3. The combination golfing aid, club shaft, and putter club head according to claim 1 wherein said first and second elongated engagement elements are pivotably secured together at said proximal ends thereof so that the lie angle defined between said club shaft and said putter club head may be selectively adjusted.

4. The combination golfing aid, club shaft, and putter club head according to claim 1 wherein said first and second elongated engagement elements are fixedly secured together at said proximal ends thereof so that the lie angle defined between said club shaft and said putter club head is fixed.

5. The combination golfing aid, club shaft, and putter club head according to claim 4 wherein said golfing aid is one of a plurality of unitary structure(s), each consisting of a fixed angle connector element, and each having a 1° to 2° lie angle change within a lie angle range of 77° to 66°.

* * * * *